US005677043A

United States Patent [19]

Hultman et al.

[11] Patent Number: 5,677,043

[45] Date of Patent: Oct. 14, 1997

[54] OPAQUE THERMAL TRANSFER PAPER FOR RECEIVING HEATED INK FROM A THERMAL TRANSFER PRINTER RIBBON

[75] Inventors: Jack D. Hultman, Neenah; Susan M. Schuh, Appleton, both of Wis.

[73] Assignee: Crown Paper Co., Oakland, Calif.

[21] Appl. No.: 593,792

[22] Filed: Jan. 30, 1996

[51] Int. Cl.[6] ..... B41M 5/40

[52] U.S. Cl. ..... 428/212; 428/195; 428/206; 428/304.4; 428/323; 428/327; 428/341; 428/402; 428/913; 428/914

[58] Field of Search ..... 8/471; 428/195, 428/206, 207, 212, 323, 327, 304.4, 402, 913, 914, 341, 342; 503/227

[56] References Cited

U.S. PATENT DOCUMENTS

| | | | |
|---|---|---|---|
| 4,541,830 | 9/1985 | Hotta et al. | 8/471 |
| 4,772,582 | 9/1988 | DeBoer | 503/227 |
| 4,798,820 | 1/1989 | Yaguchi et al. | 503/207 |
| 4,822,643 | 4/1989 | Chou et al. | 427/256 |
| 4,828,638 | 5/1989 | Brown | 156/234 |
| 4,925,827 | 5/1990 | Goto et al. | 503/207 |
| 4,996,182 | 2/1991 | Matsui et al. | 503/200 |
| 5,244,861 | 9/1993 | Campbell et al. | 503/227 |
| 5,360,780 | 11/1994 | Okumura et al. | 503/227 |
| 5,455,217 | 10/1995 | Chang et al. | 503/227 |

*Primary Examiner*—Bruce H. Hess
*Attorney, Agent, or Firm*—Thomas R. Lampe

[57] ABSTRACT

An opaque thermal transfer paper for receiving heated ink from a thermal transfer printer ribbon including a paper sheet substrate, a low density basecoat on an outer surface of the paper sheet, and a topcoat on the low density basecoat. The low density basecoat attenuates heat flux from the topcoat when the topcoat receives heated ink from a thermal transfer printer ribbon.

6 Claims, 1 Drawing Sheet

OPAQUE THERMAL TRANSFER PAPER FOR RECEIVING HEATED INK FROM A THERMAL TRANSFER PRINTER RIBBON

TECHNICAL FIELD

This invention relates to an opaque thermal transfer paper which receives heated ink from a thermal transfer printer ribbon. The opaque thermal transfer paper includes two coatings, a basecoat and a topcoat, over a paper sheet substrate and provides excellent printability with low coat weight.

BACKGROUND ART

It is well known in the prior art to employ thermal transfer techniques to print paper and other receptors. In the thermal transfer process, the paper sheet or other receptor is placed into contact with a ribbon bearing an ink, commonly a wax or wax/resin ink. A laser or other heat source is applied to the ink bearing ribbon to heat the ink at selected locations and cause the transfer thereof to the receptor. Coated paper is a common receptor.

Conventional coated papers have caused some difficulties in the printing operation particularly in regard to ink transfer from the ribbon. Many conventional coated thermal printing papers are characterized by their failure to provide good printing results at reduced heat settings. Reduced heat provides greater print head life and allows printing at increased speeds.

The present invention incorporates topcoat and basecoat coatings of specific characters which provide excellent printability and high printing speeds when low heat is employed at the print head. The basecoat coating is such that it functions as an insulating layer to reduce the rate at which the heat is transferred away from the ribbon during printing. While it is known generally in the prior art to utilize insulating layers in coated printing papers, there is no teaching of the specific basecoat coating disclosed herein which is particularly appropriate for thermal transfer printing techniques or of the combination thereof with the specific topcoat coating disclosed and claimed herein which serves as a protective layer for the insulating basecoat coating as well as cooperates therewith to provide a thermal transfer paper giving excellent printability with significantly reduced coat weights. The reduced coat weight will also allow a decrease in total basis weight to maintain the required physical properties.

The following United States patents are believed to be representative of the current state of the prior art in this field: U.S. Pat. No. 4,798,820, issued Jan. 17, 1989, U.S. Pat. No. 4,925,827, issued May 15, 1990, U.S. Pat. No. 5,455,217, issued Oct. 3, 1995, U.S. Pat. No. 5,360,780, issued Nov. 1, 1994, U.S. Pat. No. 5,244,861, issued Sep. 14, 1993, U.S. Pat. No. 4,996,182, issued Feb. 26, 1991, U.S. Pat. No. 4,828,638, issued May 9, 1989, U.S. Pat. No. 4,822,643, issued Apr. 18, 1989, U.S. Pat. No. 4,772,582, issued Sep. 20, 1988, and U.S. Pat. No. 4,541,830, issued Sep. 17, 1985.

DISCLOSURE OF INVENTION

The present invention relates to an opaque thermal transfer paper for receiving heated ink from a thermal transfer printer ribbon.

The opaque thermal transfer paper constructed in accordance with the teachings of the present invention includes a substrate comprising a paper sheet having an outer surface.

A low density basecoat is on the outer surface of the paper sheet.

A topcoat coating is on the basecoat coating, the low density basecoat coating being sandwiched between the substrate and the topcoat coating for attenuating the heat flux from the topcoat coating to the substrate when the topcoat coating receives heated ink from a thermal transfer printer ribbon.

The low density basecoat coating has a coating weight within the range of from about 0.3 g/m$^2$ to about 10 g/m$^2$, preferably from about 1 g/m$^2$ to about 8 g/m$^2$, and a coating thickness within the range of from about 1 micron to about 30 microns, preferably from about 3 microns to about 24 microns.

The topcoat coating has a coating weight within the range of from about 1 g/m$^2$ to about 20 g/m$^2$, preferably from about 1.3 g/m$^2$ to about 15 g/m$^2$, and a coating thickness within the range of from about 1 micron to about 20 microns, preferably from about 1.3 microns to about 15 microns.

MODES FOR CARRYING OUT THE INVENTION

Figure 1:
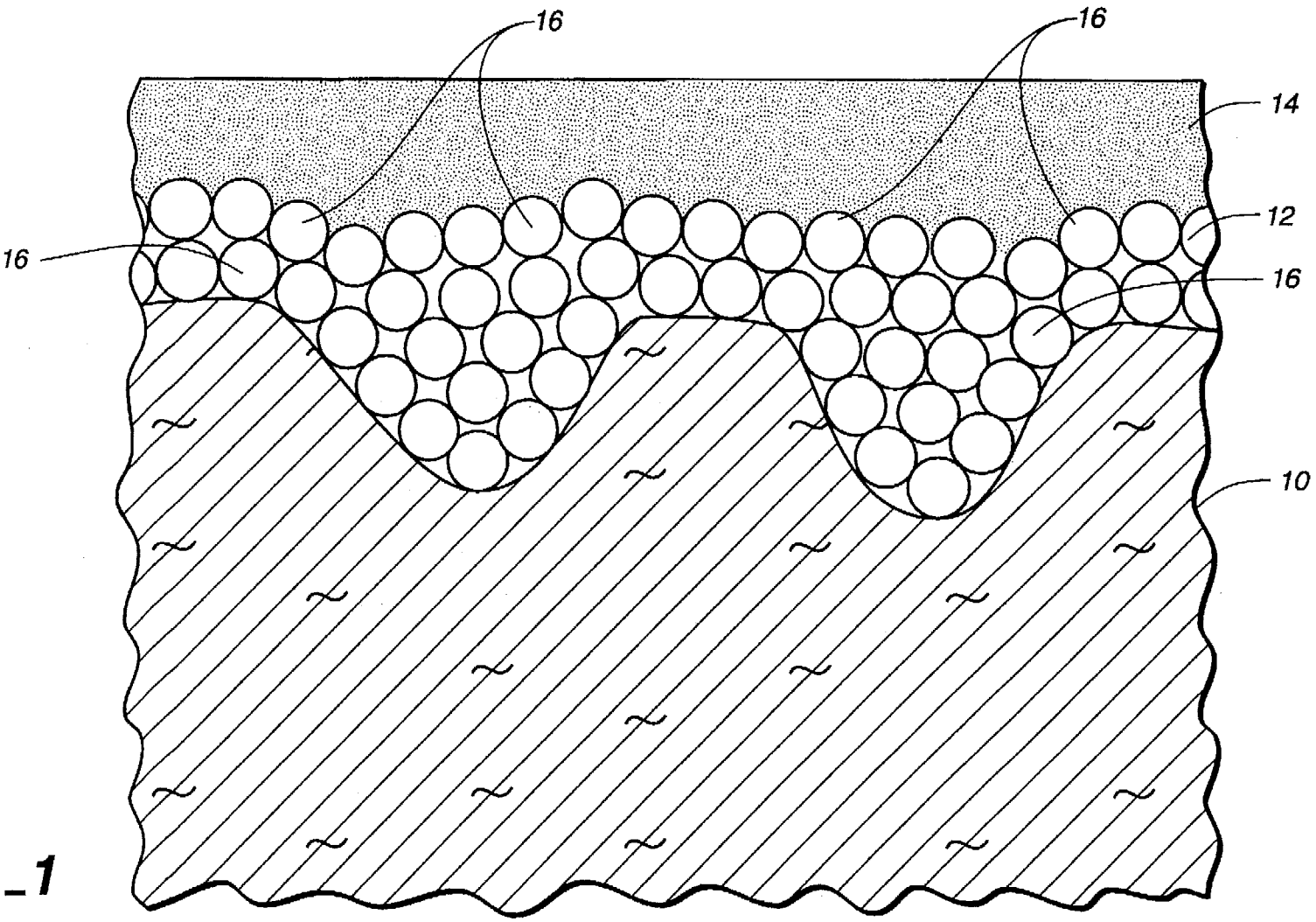
FIG. 1 is a greatly enlarged cross-sectional view of a portion of an embodiment of opaque thermal transfer paper constructed in accordance with the teachings of the present invention.

Referring now to FIG. 1, an opaque thermal transfer paper constructed in accordance with the teachings of the present invention includes a substrate comprising a paper sheet having an outer surface. The substrate is designated by reference numeral 10. A low density basecoat coating 12 is on the outer surface of the paper sheet, FIG. 1 illustrating in somewhat exaggerated detail the fact that the basecoat coating fills in the voids located at the outer surface of the paper.

A topcoat coating 14 is on the low density basecoat coating. The low density basecoat coating is thus sandwiched between the substrate and the topcoat coating. The nature of the basecoat coating 12 is such that it attenuates the heat flux from the topcoat coating to the substrate when the topcoat coating receives heated ink from a thermal transfer printer ribbon (not shown).

The low density basecoat coating has a coating weight within the range of from about 0.3 g/m$^2$ to about 10 g/m$^2$, preferably from about 1 g/m$^2$ to about 8 g/m$^2$, and a coating thickness within the range of from about 1 micron to about 30 microns, preferably from about 3 microns to about 24 microns.

The topcoat coating has a coating weight within the range of from about 1 g/m$^2$ to about 20 g/m$^2$, preferably from about 1.3 g/m$^2$ to about 15 g/m$^2$, and a coating thickness within the range of from about 1 micron to about 20 microns, preferably from about 1.3 microns to about 15 microns.

The topcoat is for the specific purpose of being receptive to the molten ink on a print ribbon with which it comes in contact during the printing process. Coating 14 also serves to protect the basecoat 12 which could be relatively easily marked and marred by contact with foreign objects. The topcoat is designed to give optimum receptivity to wax and wax/resin inks typically used to thermally print on coated papers. In the fraction of a second that the molten ink is in contact with the coating 14, it must wet and attach to the coating or it will be pulled away by the ribbon as it breaks contact with the paper, resulting in skips in the print. This requires that the ink wet and penetrate the coating surface and adhere well enough to resist the force pulling it away from the coating.

The topcoat consists of a combination of inorganic and possibly organic pigments which tend to provide a very open coating. The combination of different particle sizes and shapes tend to result in particle packing which is more open than the pigments normally used in paper coating. The pigments can include calcium carbonate, calcined kaolin clays, kaolin clay, structured kaolin clay, aluminum trihydrate, titanium dioxide, talc, silica including fumed and precipitated grades, urea formaldehyde, and calcium silicate. The amount of pigment is preferably greater than 40 percent by weight of the topcoat.

The binder holding the topcoat coating together and preventing "picking" during printing should be a smaller proportion of the coating layer. These binders can include starch, protein, casein, polyvinyl alcohol, or any synthetic binders commonly used in paper coatings. The topcoat coating should also contain a water holding resin such as sodium alginate, CMC, or the like.

The basecoat coating 12 is for the purpose of smoothing the surface of the support material or substrate, attenuating the heat flux to the substrate, providing proper ink spread, and holding the topcoat on the surface of the substrate.

The basecoat consists of pigments, binder, and water holding and viscosifying agents as the main components. The pigments advantageously can consist of hollow sphere or solid sphere plastic pigments consisting of polystyrene, styrene-acrylic and other organic pigments. The addition of a small amount of inorganic pigments can also be included with the above-identified plastic pigments. In FIG. 1, pigment spheres are identified by reference numeral 16.

The binders may be the synthetic binders described above with respect to the topcoat coating in amounts ranging from about 10 percent to about 60 percent by weight of the basecoat coating. Natural binders such as starch and protein can also be used. The binders serve to hold the coating together and prevent "picking" during the printing operation. A viscosifying agent with water holding properties is recommended to promote coater runability. Hollow sphere pigments, if employed in the basecoat coating, should have diameters within the range of from about 0.2 microns to about 2 microns. If solid, the pigment spheres should have diameters within the range of from about 0.2 microns to about 1 micron.

By referring to the following examples, the present invention will now be explained in greater detail.

Coating Application

The base and topcoats disclosed in the following examples were applied to paper using either wire wound rods of different sizes or a Time-Life hand operated blade coater. The rods were used to apply the heavier coat weights. The drying of the rod coating was done with a hand held hot air gun immediately after coating. The semi dried coated paper was then placed on a photodrier coated side to the chrome drum drier to finish the drying. The paper coated on the Time-Life coater was only dried on the photodrier since the blade applies a much lower coat weight. The basecoat was dried before the topcoat was applied. All coatings were applied to 74 g/m$^2$ smooth base papers.

Evaluation

The image receiving sheets were printed using a Zebra 140L thermal transfer printer which is capable of printing a 2, 3, 4 and 6 in/sec at 203 dots/inch resolution. The printhead heat adjustment has 21 levels with level 1 being the lowest and 21 the highest print head temperature. The printer was capable of printing with all types of ribbons 5.2 inches wide or narrower. The hand coated sheets were fed through the printer by taping the front edge of the approximately 4.5 inch wide test sheets, coated side out, to a five inch wide carrier web. A test pattern was designed to print ladder and picket fence bar codes of different sizes along with numbers of several sizes. The prints were evaluated visually for skips, edge acuity, solid fill and contrast difference. Test instruments (bar code verifiers) are available to test some of these parameters such as bar code readability but none were as good as the eye for judging the overall print quality.

Several thermal transfer ribbons were used in the evaluation since wax and wax/resin ribbons do not always print the same on the different papers. The ribbons used included a wax ribbon (I-28) from IIMAK, a wax/resin (5555) from Wallace and a wax/resin (05184-3) from Intermec. The wax ink melts at a lower temperature than the Wax/resin ink but is not as scuff resistant.

The prints were visually compared against each other and ratings assigned. Ratings of A, B, C, D and F were used with plus and minus added for indicating very small differences. A rating of A indicates an essentially flaw free print while an F would indicate a very broken up print with less than 50% ink transfer. A standard print speed of 4 in/sec was adopted with only the print head temperature being adjusted to give an A print rating on the best sample if possible. If the print head temperature was set too high it became more difficult to judge the prints since overburn will become a problem on the better samples. Overburn is indicated when filling between the bar code lines becomes apparent. Some experience is required to judge the print quality.

EXAMPLE 1

The base and topcoat formulations used in Example 1 are given in Table 1 below. The formulations are given in parts as received from the supplier. The solids levels of all components are given in a separate section also giving the description of all the chemicals used in the Examples.

The print quality ratings are given in Table 2 below for the different base and topcoat combinations along with the coat weights of each. The paper coated with Basecoat A and Topcoat A (paper A/A) gives the poorest print of all the samples even though it had the heaviest base and topcoat weight. This combination would normally produce a smoother surface. At a total coat weight of 28 g/m$^2$, it does not accept the ink very well at the low burn temperature setting. Replacing Basecoat A which contains mostly inorganic pigments of high density with one containing only low density pigments gives much improved print quality. Paper B/A wherein the topcoat remained the same showed a significant print improvement. Reducing the topcoat coat weight of paper B/A gave further improvement depending upon the ribbon type used. When the basecoat weight was reduced further with a slight change in basecoat formulation (paper C/A), the print quality showed a small improvement with the wax ribbon and a slight degradation with the wax/resin ribbon, again depending upon the ribbon type.

Topcoat A was chosen to be tested with the different basecoats because previous evaluation had shown it to be a very receptive coating for thermal transfer printing. Topcoat B was applied to the Basecoat C to show that the structure requires a combination of base and topcoat to produce a superior print. Paper C/B showed a significant print quality reduction over those containing Basecoat B or C and Topcoat A. Topcoat B is a normal paper coating formulation used in the paper industry for impact printing such as offset, flexo or gravure. It was not designed to be receptive to the molten inks present in thermal transfer printing. This example shows that there is a synergistic effect between the base and topcoat in this coating structure.

EXAMPLE 2

The base and topcoat formulations used in Example 2 are given in Table 3 below. Again the formulations are given in parts as received from the supplier.

This example was chosen to show the effects of the particle size and particle morphology of the plastic pigments in the basecoat on print quality. The print quality ratings along with the particle size and coat weight are given in Table 4 below. The coatings containing the plastic pigments were prepared so that they have an equal binder to pigment ratio by volume and very similar viscosities. The coatings were applied to the same paper in an identical manner so as not to introduce any other variables.

The largest size hollow sphere plastic pigment (HP-1055) gives the best print rating with each print ribbon. As the particle size of the hollow sphere pigment decreases, the print rating also decreases. The solid sphere pigment did not perform as well as the hollow spheres but still was better than that of the topcoat used as a basecoat or no basecoat at all. The single coat of the topcoat printed the poorest of all the coatings even at the significantly higher coat weight.

Effect of Calendering

The need for calendering depends upon the basesheet and roughness of the coated sheet but normally is not required. The need for calendering can only be determined by print testing. The only purpose of calendering is to allow contact between the paper and the print ribbon. Calendering also affects the gloss of the paper and reduces the tooth designed into the coating. The microscopic smearing that takes place during calendering reduces the areas to which the ink can attach thereby reducing adhesion and resulting in some of the ink remaining with the ribbon during printing. This will result in skips which can easily be seen by the eye or bar code scanner.

Bulk Volume of the Coating in Example 2

Since the coatings on the paper are very thin and somewhat non-uniform, there is no way to accurately measure the porosity or bulk density of the coating layers in that form. The only way to make any porosity or density measurements is to cast a film of the coating on a smooth non-porous substrate such as tinfoil. The coating density can then be measured by physical means. Coatings were cast on tinfoil so that the film could be cut to a known size, weighed, and thickness determined either microscopically or by using a sensitive micrometer. From these measurements the bulk density and volume were easily calculated.

The bulk volume of the coatings used in Example 2 are given in Table 5 below in a manner which is easy to understand. The coating thickness of a 1 g/m$^2$ coating is expressed in um. For example, a 1 g/m$^2$ coating of water which has a specific gravity of 1 would produce a coating 1 um thick. However, if the water coating contained any voids such as air, the 1 g/m$^2$ coating would be more than 1 um thickness. The coating components in all three basecoatings described in Example 2 had specific gravities of 1.05; if no void were present in the coatings, the thickness would be slightly less than 1 um. However, the coating thickness is significantly greater than 1 indicating the presence of significant void volume. The coatings containing the hollow sphere pigments have the largest void volume. The largest hollow sphere pigment (HP-1055) which also has the largest internal void volume gave the greatest film thickness. The solid sphere pigment with no internal voids gave the smallest. The print quality ratings given in Table 4 show that the basecoat with the highest bulk volume also gave the best print while the solid sphere basecoat was not as good.

A thicker basecoating serves two purposes. First the greater film thickness of the coating offers better and more uniform insulating properties. This allows the heat from the print head to be used in melting ink rather than passing into the paper coating. Second, the greater film volume gives better surface smoothness of the paper surface resulting in better contact between the paper and the printing ribbon. At an equal weight, the coating containing HP-1055 gives superior print quality compared to the other coatings with smaller bulk volume. Applying additional coating of the other plastic pigments may also give print quality comparable to the larger size pigment but with an increase in cost of materials and energy.

Topcoat A was also given in the Table to illustrate the effect of using more dense pigments in the basecoat. The coating was porus but the volume of coating components was also much smaller. The topcoat coating would require more than 3 times the coat weight just to equal the best base in coating thickness. The higher mass or density would also dissipate the heat from the print ribbon resulting in more heat being required to melt the ink on the ribbon and allow it to transfer to the paper surface. This also results in reduced spreading of the ink dots giving an incomplete coverage in the solid print area at low burn temperatures.

DESCRIPTION OF CHEMICALS USED IN STUDY

Ropaque HP-91—Hollow sphere plastic pigment from Rohm & Haas. The hollow spheres have particle size of 1 um with a shell thickness of 0.1 um and contains 50% void volume. The pigment slurry is 27.5% solids.

Ropaque HP-1055—Hollow sphere plastic pigment from Rohm & Haas. The hollow spheres have a particle size of 1 um with a shell thickness of 0.09 um and contain 55% void volume. The pigment slurry is supplied at 26.5% solids.

Ropaque HP-433—Hollow sphere plastic pigment from Rohm & Haas. The hollow spheres have a particle size of 0.4 um with a shell thickness of 0.06 um and contain 33% void volume.

Lytron 2705 is a solid sphere plastic pigment from Morton International. The particle size is 0.65 to 0.8 um in diameter. The pigment slurry is supplied at 48% solids.

Arisilex—Calcined kaolin clay from Engelhard supplied at 51% solids.

Hyrasperse—Kaolin clay from Huber supplied at 71% solids.

Hydracarb 60—Ground calcium carbonate from Omya supplied at 75% solids.

Carbitol 75—Ground calcium carbonate from ECC supplied at 75% solids.

Cab-O-Sperse 1695—Fumed silica from Cabot supplied at 17% solids.

Dow 617—Styrene-butadiene latex from Dow supplied at 50% solids.

RAP-125—Styrene-butadiene latex from Dow supplied at 50% solids.

Rhoplex B-15J—Acrylic latex from Rohm & Haas supplied at 46% solids.

Kelgin MV & HV—Sodium alginate from Kelco supplied in dry form.

Nopcote C-104—Calcium stearate from Henkel supplied at 50% solids.

TABLE 1

EXAMPLE 1.

| COMPONENTS | PARTS, AS RECEIVED |
|---|---|
| BASECOAT A | |
| ANSILEX | 11.5 |
| HYDRASPERSE | 100 |
| ROPAQUE HP-91 | 24.3 |
| DOW 617 | 25.1 |
| KELGIN MV | 0.1 |
| AMMONIA (28%) | 0.3 |
| WATER | 9.0 |
| BASECOAT B | |
| ROPAQUE HP-91 | 100 |
| DOW 617 | 27.5 |
| BASECOAT C | |
| ROPAQUE HP-1055 | 100 |
| DOW 617 | 26.5 |
| KELGIN HV (1.5% SOLIDS) | 8.8 |
| TOPCOAT A | |
| ANSILEX | 39.2 |
| HYDRACARB 60 | 100 |
| CAB-O-SPERSE 1695 | 29.0 |
| DOW 617 | 24.0 |

TABLE 1-continued

EXAMPLE 1.

| COMPONENTS | PARTS, AS RECEIVED |
|---|---|
| KELGIN MV | 0.3 |
| AMMONIA (28%) | 0.3 |
| WATER | 24.0 |
| TOPCOAT B | |
| HYDRASPERSE | 100 |
| HYDRACARB 60 | 10.5 |
| RAP-125 | 23.7 |
| NOPCOTE C-104 | 0.8 |
| AMMONIA (28%) | 0.3 |
| WATER | 5.0 |

TABLE 2

EXAMPLE 1.

| COATING ID | | COAT WEIGHT, g/m$^2$ | | | PRINT QUALITY RATING | |
|---|---|---|---|---|---|---|
| BASE-COAT | TOP-COAT | BASE | TOP | TOTAL | WAX | WAX/RESIN |
| A | A | 15.0 | 13.0 | 28.0 | C– | D– |
| B | A | 6.2 | 13.0 | 19.2 | A– | B– |
| B | A | 6.2 | 2.9 | 9.1 | A– | A |
| C | A | 1.8 | 2.9 | 4.7 | A | B+ |
| C | B | 1.8 | 3.6 | 5.4 | B | D+ |

The higher coat weights were applied with a wire wound rod while the lower coat weights of 3.6 g/m$^2$ or lower were applied with the Time-Life blade coater.

An IIMAK 1-28 wax ribbon was printed at a burn temperature of 1 and a speed of 4 in/sec.

A Wallace 5555 wax/resin ribbon was printed at a burn temperature of 2 at 4 in/sec.

TABLE 3

EXAMPLE 2 BASECOAT FORMULATIONS

| BASECOAT | COATING COMPONENTS, PARTS AS RECEIVED | | | | | |
|---|---|---|---|---|---|---|
| | ROPAQUE | LYTRON | ROPAQUE | RHOPLEX | KELGIN | WATER |
| ID | HP-1055 | 2705 | 433 | B-15J | HV | |
| A | 100 | | | 28.8 | 8.3 | 0.4 |
| B | | 100 | | 25.3 | 15.0 | 2.3 |
| C | | | 100 | 27.3 | 11.4 | 2.0 |

The Kelgin HV was added a solids level of 1.6%

TOPCOAT A

| COMPONENTS | PARTS, AS RECEIVED |
|---|---|
| ANSILEX | 39.2 |
| CARBITOL 75 | 100 |
| CAB-O-SPERSE | 29.4 |
| RHOPLEX B-15J | 26.1 |
| KELGIN MV | 0.3 |
| AMMONIA | 0.3 |
| WATER | 21.3 |

TABLE 4

EXAMPLE 2. EFFECT OF BASECOAT COMPOSITION ON PRINT QUALITY

| PAPER ID | BASECOAT ID | BASECOAT PIGMENT PARTICLE SIZE, um | TYPE OF PIGMENT | TOPCOAT ID | COAT WEIGHT, g/m² BASE | TOP | TOTAL | PRINT QUALITY RATING WAX | WAX/RESIN |
|---|---|---|---|---|---|---|---|---|---|
| A | A | 1.0 | HOLLOW | A | 1.9 | 2.6 | 4.5 | A | A |
| B | C | 0.4 | HOLLOW | A | 1.6 | 2.5 | 4.1 | A− | B+ |
| C | B | 0.8 | SOLID | A | 2.1 | 2.9 | 5.0 | B+ | B |
| D | TC-A | | | A | 3.9 | 4.0 | 7.9 | C+ | C |
| E | NONE | | | A | | 16.7 | 16.7 | D | D |

The topcoat formulation is given in Table 3
Coatings A–D (both base and topcoats) were applied with a Time-Life blade coaler. Coating E was applied with a #7 wire wound rod.
An IIMAK I-28 wax ribbon was printed at a burn temperature of 1 at a speed of 4 in/sec.
An Intermec 051804-3 wax/resin ribbon was printed at a burn temperature of three at 4 in/sec.

TABLE 5

COMPARISON OF BULK COATING VOLUME OF BASECOATS

| COATING ID | COATING THICKNESS OF 1 g/m², μm |
|---|---|
| BASECOAT A (HP-1055) | 3.12 |
| BASECOAT B (LYRON 2705) | 1.77 |
| BASECOAT C (HP-433) | 2.35 |
| TOPCOAT A | 1.00 |

The basecoatings were prepared at equal binder/pigment ratio by volume. The formulations are given in Table 3.
A 1 g/m² coating with a specific gravity of 1.0 with no pores would give a coating thickness of 1 μm.

We claim:

1. An opaque thermal transfer paper for receiving heated ink from a thermal transfer placed in contact with said opaque thermal transfer paper printer ribbon, said opaque thermal transfer paper comprising in combination:

a. a substrate comprising a paper sheet having an outer surface;

b. a basecoat coating directly coated on said outer surface of said paper sheet, the coating weight of said basecoat coating ranging between 0.3 g/m² to about 10 g/m² and the thickness of said basecoat coating ranging between about 1 micron and about 30 microns, said basecoat coating comprising discrete, opaque, plastic, hollow, pigment spheres ranging from about 0.2 microns to about 2 microns in diameter and binders holding together said discrete, opaque, plastic, hollow, pigment spheres, said binders constituting from about 10 percent to about 60 percent by weight of said basecoat coating; and c. a topcoat coating directly coated on the basecoat coating, said topcoat coating having a coating weight within the range of from about 1 g/m² to about 20 g/m² and a coating thickness within the range of from about 1 micron to about 20 microns, said topcoat coating including a plurality of pigment particles having different particle shapes and particle sizes which cooperate to provide a generally open topcoat coating for receiving heated ink from a thermal transfer printing ribbon placed in contact with the topcoat coating, said topcoat coating further including a water holding viscosifying agent, said basecoat coating sandwiched between said substrate and said topcoat coating for attenuating the heat flux from said topcoat coating to said substrate when said topcoat coating receives heated ink from a thermal transfer printer ribbon and for filling in any voids located at said outer surface of said paper sheet.

2. The opaque thermal transfer paper according to claim 1 wherein the coating weight of said low-density basecoat coating is within the range of from about 1 g/m² to about 8 g/m².

3. The opaque thermal transfer paper according to claim 1 wherein the coating thickness of said low-density basecoat coating is within the range of from about 3 microns to about 24 microns.

4. The opaque thermal transfer paper according to claim 1 wherein said pigment particles comprise more than 40% by weight of said topcoat coating.

5. The opaque thermal transfer paper according to claim 1 wherein said topcoat coating has a weight within the range of from about 1.3 g/m² to about 15 g/m².

6. The opaque thermal transfer paper according to claim 1 wherein said topcoat coating has a thickness within the range of from about 1.3 microns to about 15 microns.

* * * * *